US011313583B2

(12) United States Patent
Seki et al.

(10) Patent No.: US 11,313,583 B2
(45) Date of Patent: Apr. 26, 2022

(54) FALL PREVENTION STRUCTURE OF ELECTRIC COMPONENT COVER IN REFRIGERATION CYCLE APPARATUS

(71) Applicant: Mitsubishi Electric Corporation, Tokyo (JP)

(72) Inventors: Yusaku Seki, Tokyo (JP); Tatsuo Furuta, Tokyo (JP); Naoya Matsunaga, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 85 days.

(21) Appl. No.: 16/627,421

(22) PCT Filed: Sep. 7, 2017

(86) PCT No.: PCT/JP2017/032273

§ 371 (c)(1),
(2) Date: Dec. 30, 2019

(87) PCT Pub. No.: WO2019/049259

PCT Pub. Date: Mar. 14, 2019

(65) Prior Publication Data

US 2021/0003315 A1 Jan. 7, 2021

(51) Int. Cl.

| | |
|---|---|
| ***F24F 13/20*** | (2006.01) |
| ***F25B 49/02*** | (2006.01) |
| ***F24F 1/0007*** | (2019.01) |

(52) U.S. Cl.

CPC ..... *F24F 13/20* (2013.01); *F25B 49/02* (2013.01); *F24F 1/0007* (2013.01)

(58) Field of Classification Search

CPC . F24F 13/20; F24F 1/0007; F24F 1/20; F25B 49/02

See application file for complete search history.

(56) References Cited

U.S. PATENT DOCUMENTS 5,461,880 A * 10/1995 Bolton ..... F24F 13/20 62/298
5,723,053 A * 3/1998 Momose ..... B41J 2/14274 216/2

(Continued)

FOREIGN PATENT DOCUMENTS

JP 02298746 A * 12/1990
JP H07-190406 A 7/1995

(Continued)

OTHER PUBLICATIONS

International Search Report of the International Searching Authority dated Nov. 28, 2017 for the corresponding International application No. PCT/JP2017/032273 (and English translation).

*Primary Examiner* — Kun Kai Ma
(74) *Attorney, Agent, or Firm* — Posz Law Group, PLC

(57) ABSTRACT

A fall prevention structure of an electric component cover in a refrigeration cycle apparatus includes an electric component box housing an electric component of a refrigeration cycle apparatus. The electric component box includes a casing, a side of which is open, and an electric component cover configured to cover, in an upright position, an opening of the casing and to be screwed to the casing. The electric component cover includes a catch including a backward-extending portion and an upward-extending portion. The backward-extending portion extends backward from an upper end portion of the electric component cover. The upward-extending portion extends upward from an end portion of the backward-extending portion. In a state in which the electric component cover is screwed to the casing, the catch is inserted into an insertion slot disposed in a portion extending in an up-down direction of the casing. When the electric component cover is unscrewed from the casing, the electric component cover does not fall from the (Continued)

casing by the catch being caught by a portion above the insertion slot.

6 Claims, 5 Drawing Sheets

(56) References Cited

U.S. PATENT DOCUMENTS

| | | | | |
|---|---|---|---|---|
| 6,009,717 | A * | 1/2000 | Hernandez | F24F 1/027 62/262 |
| 6,189,328 | B1 * | 2/2001 | Mochizuki | F24F 1/0007 62/298 |
| 6,318,105 | B1 * | 11/2001 | Bushnell | F24F 1/027 62/262 |
| 2011/0113807 | A1 * | 5/2011 | Kojima | F24F 1/0057 62/262 |
| 2016/0033161 | A1 | 2/2016 | Koyanagi et al. | |
| 2017/0248328 | A1 * | 8/2017 | Eskew | F24F 1/22 |
| 2019/0309963 | A1 * | 10/2019 | Zaki | F24F 1/38 |
| 2020/0224923 | A1 * | 7/2020 | Suehiro | F24F 11/74 |
| 2020/0248927 | A1 * | 8/2020 | Suehiro | F24F 11/89 |

FOREIGN PATENT DOCUMENTS

| | | | | |
|---|---|---|---|---|
| JP | 10318564 | A | * | 12/1998 |
| JP | 2009210185 | A | * | 9/2009 |
| JP | 2015-124905 | A | | 7/2015 |
| JP | 2016-035342 | A | | 3/2016 |

* cited by examiner

FALL PREVENTION STRUCTURE OF ELECTRIC COMPONENT COVER IN REFRIGERATION CYCLE APPARATUS

CROSS REFERENCE TO RELATED APPLICATION

This application is a U.S. national stage application of PCT/JP2017/032273 filed on Sep. 7, 2017, the contents of which are incorporated herein by reference.

TECHNICAL FIELD

The present invention relates to a fall prevention structure of an electric component cover. The fall prevention structure is a structure for preventing an electric component cover from falling when removing the electric component cover from an electric component box included in a refrigeration cycle apparatus.

BACKGROUND ART

Examples of a refrigeration cycle apparatus include a wall-mounted air-conditioning apparatus. An indoor unit of such an air-conditioning apparatus includes an electric component box that houses a control unit and other components. The electric component box includes a casing and an electric component cover that covers an opening of the casing. The electric component cover is fixed to the casing with a screw. During maintenance, the control unit in the electric component box is accessible by unscrewing the screw and removing the electric component cover from the casing.

CITATION LIST

Patent Literature

Patent Literature 1: Japanese Unexamined Patent Application Publication No. 7-190406

SUMMARY OF INVENTION

Technical Problem

In Patent Literature 1, an electric component cover is fixed to a casing with a screw. However, there is no other engagement unit than the screw, and thus when the screw is unscrewed, the electric component cover falls from the casing. As a result, an operator has to unscrew the screw while holding the electric component cover such that the electric component cover does not fall from the casing, and thus there arises a problem of impairing working efficiency.

The present invention has been made in view of such a problem, and an object of the present invention is to provide a fall prevention structure of an electric component cover in a refrigeration cycle apparatus. The fall prevention structure can prevent an electric component cover from falling when removing the electric component cover from an electric component box.

Solution to Problem

A fall prevention structure of an electric component cover in a refrigeration cycle apparatus according to an embodiment of the present invention includes an electric component box housing an electric component of a refrigeration cycle apparatus. The electric component box includes a casing, a side of which is open, and an electric component cover configured to cover, in an upright position, an opening of the casing, and is screwed to the casing. The electric component cover includes a catch including a backward-extending portion and an upward-extending portion. The backward-extending portion extends backward from an upper end portion of the electric component cover. The upward-extending portion extends upward from an end portion of the backward-extending portion. In a state where the electric component cover is screwed to the casing, the catch is inserted into an insertion slot disposed in a portion extending in an up-down direction of the casing. When the electric component cover is unscrewed from the casing, the electric component cover does not fall from the casing by the catch being caught by a portion above the insertion slot.

Advantageous Effects of Invention

According to an embodiment of the present invention, even if the electric component cover is unscrewed from the casing, the catch disposed at the electric component cover is caught by the portion above the insertion slot disposed in the casing. Thus, the electric component cover can be prevented from falling from the casing.

DESCRIPTION OF EMBODIMENTS

Figure 1:
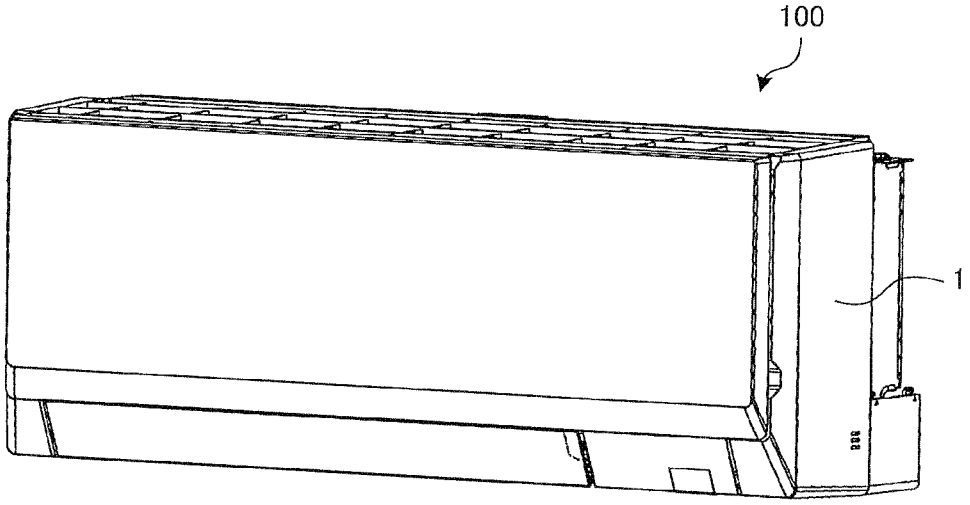
FIG. 1 is a perspective view of an indoor unit of an air-conditioning apparatus according to Embodiment 1 of the present invention.

Embodiment of the present invention will be described below with reference to, for example, the drawings. In the following drawings, the components assigned the same reference signs are the same or equivalent components, and this is common throughout Embodiment described below. The configuration of the components in the entire description is merely an example, and the configuration is not limited to the configuration in the description. Unless otherwise noted, "up", "down", "left", "right", "forward", and "backward", which are used in the following description, mean directions when an indoor unit is viewed from the front. The relationships of the sizes of the components in the drawings may differ from the relationships of the sizes of the actual components.

The present invention relates to a fall prevention structure of an electric component cover. Hereinafter, an air-conditioning apparatus will be described as an example of a refrigeration cycle apparatus to which the fall prevention structure of an electric component cover is applied.

Embodiment 1

Figure 2:
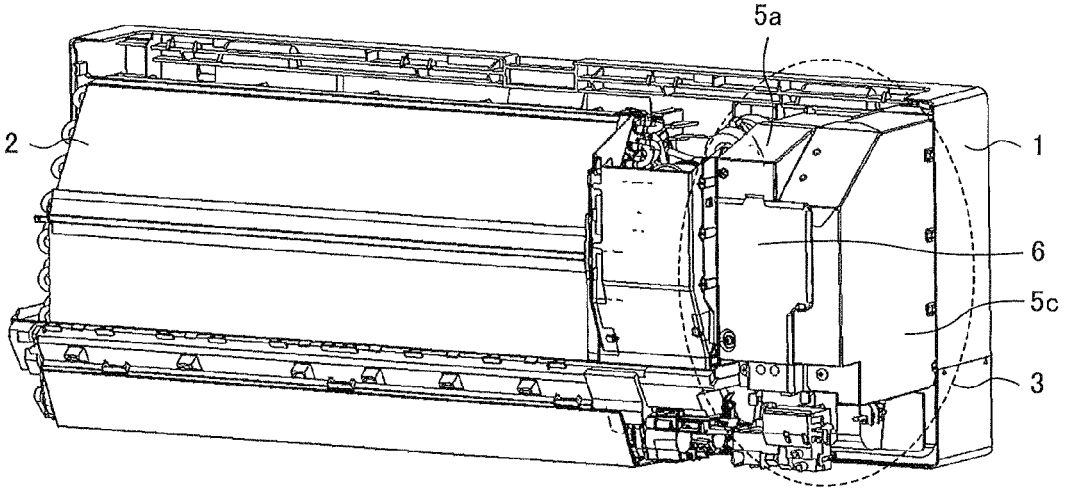
FIG. 2 is a perspective view illustrating the indoor unit in FIG. 1 from which a front cover is removed.

FIG. 1 is a perspective view of an indoor unit of an air-conditioning apparatus according to Embodiment 1 of the present invention. FIG. 2 is a perspective view illustrating the indoor unit in FIG. 1 from which a front cover is removed.

An indoor unit 100 is a wall-mounted indoor unit disposed on an upper portion of a wall surface of an air-conditioning target room. An indoor heat exchanger 2 is disposed in a casing 1 of the indoor unit 100, and an electric component box 3 is disposed beside the indoor heat exchanger 2. The portion surrounded by a broken line in FIG. 2 is the electric component box 3.

Figure 3:
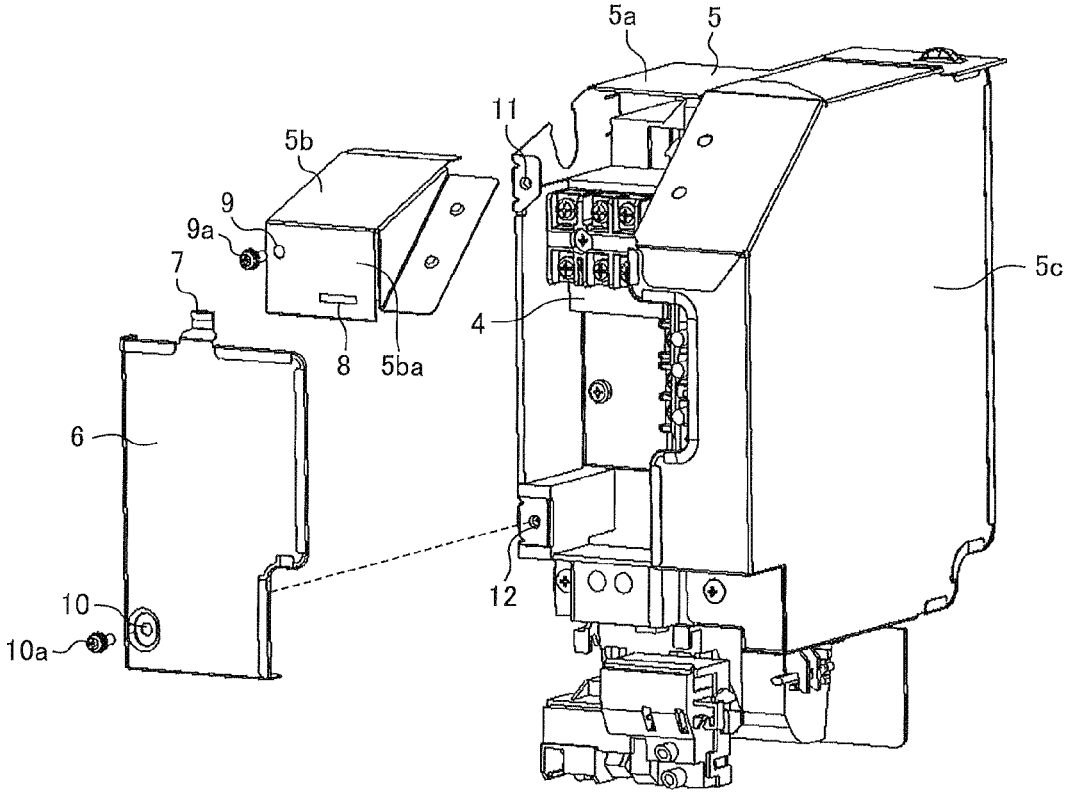
FIG. 3 is an exploded perspective view of a portion of an electric component box in FIG. 2.
Figure 4:
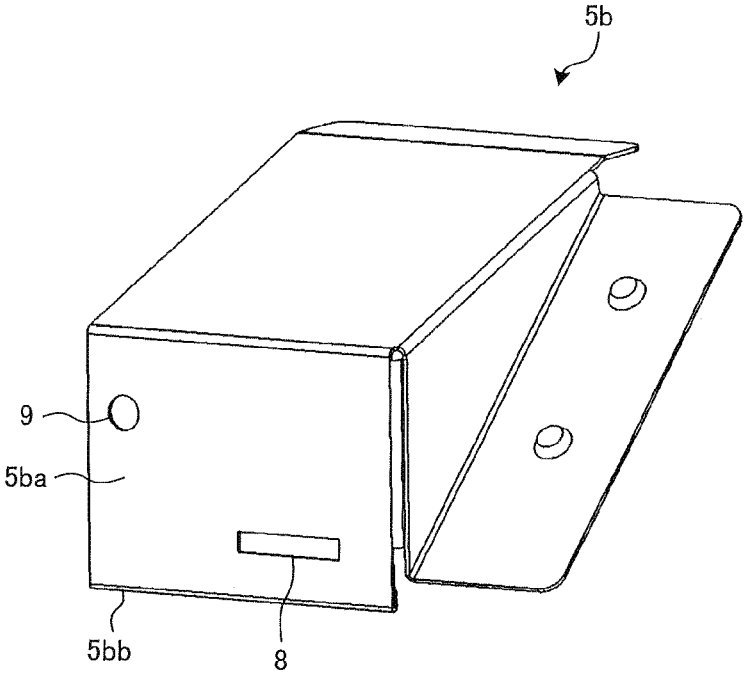
FIG. 4 is a perspective view of an upper cover of the electric component box in FIG. 2.
Figure 5:
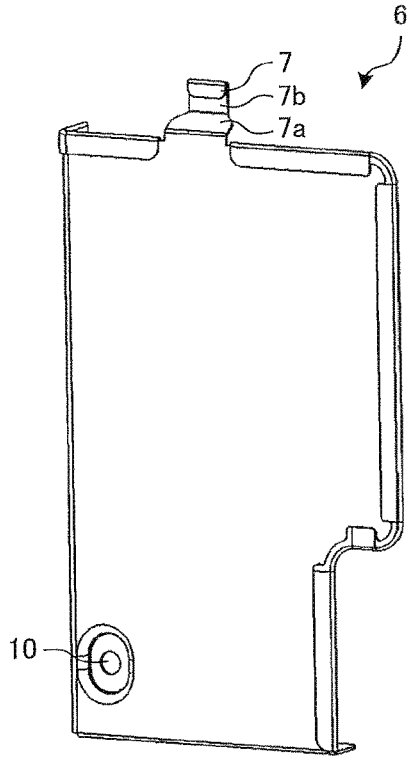
FIG. 5 is a perspective view of an electric component cover of the electric component box in FIG. 2.
Figure 6:
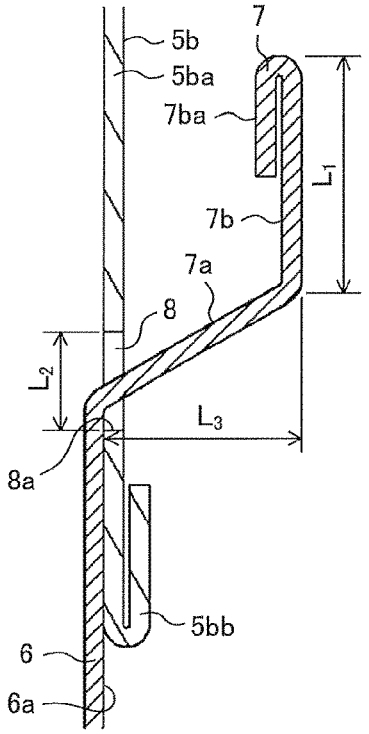
FIG. 6 is a sectional view of a relevant part in a state in which the electric component cover of the electric component box in FIG. 2 is attached to the upper cover of a casing.

FIG. 3 is an exploded perspective view of a portion of the electric component box in FIG. 2. FIG. 4 is a perspective view of an upper cover of the electric component box in FIG. 2. FIG. 5 is a perspective view of an electric component cover of the electric component box in FIG. 2. FIG. 6 is a sectional view of a relevant part in a state in which the electric component cover of the electric component box in FIG. 2 is attached to the upper cover of a casing.

The electric component box 3 includes a casing 5 and an electric component cover 6, which covers an opening of the casing 5. The casing 5 includes a casing body 5*a*, an upper cover 5*b*, and a right cover 5*c*. The casing body 5*a* houses a control unit 4, which is an electric component. The upper cover 5*b* covers an upper opening of the casing body 5*a*. The right cover 5*c* covers a right opening of the casing body 5*a*. In a state where the upper cover 5*b* and the right cover 5*c* are attached to the casing body 5*a*, the front of the casing 5 is open, and the opening is covered with the electric component cover 6 in an upright position.

The upper cover 5*b* has a front surface 5*ba*, which extends in an up-down direction. An insertion slot 8, into which a catch 7 (described below) of the electric component cover 6 is inserted, and a screw hole 9 are disposed in the front surface 5*ba*. The upper cover 5*b* is screwed to the casing body 5*a* by screwing a screw 9*a* passing through the screw hole 9 into a screw hole 11 disposed in the casing body 5*a*. In addition, a curling portion 5*bb*, which is subjected to curling and folded back to the backward side, is formed at a lower end portion of the upper cover 5*b*. The curling portion 5*bb* corresponds to a first curling portion of the present invention.

The catch 7 is provided at an upper end portion of the electric component cover 6, and a screw hole 10 is provided in a lower end portion of the electric component cover 6. The catch 7 includes a backward-extending portion 7*a* and an upward-extending portion 7*b*. The backward-extending portion 7*a* extends obliquely backward and upward from an upper end portion of the electric component cover 6. The upward-extending portion 7*b* extends upward from an end portion of the backward-extending portion 7*a*. In addition, a curling portion 7*ba*, which is subjected to curling and folded back to the forward side, is provided at an end portion of the upward-extending portion 7*b*. The curling portion 7*ba* corresponds to a second curling portion of the present invention.

A length $L_1$ of the upward-extending portion 7*b* of the catch 7 in the up-down direction is set to be larger than a length $L_2$ of the insertion slot 8 of the upper cover 5*b* in the up-down direction. In addition, "the length obtained by subtracting the thickness of the upper cover 5*b* from a length $L_3$ of the backward-extending portion 7*a* in a horizontal direction" is set to 5 mm or more and 20 mm or less. The reason why such lengths are set will be described below.

Figure 7:
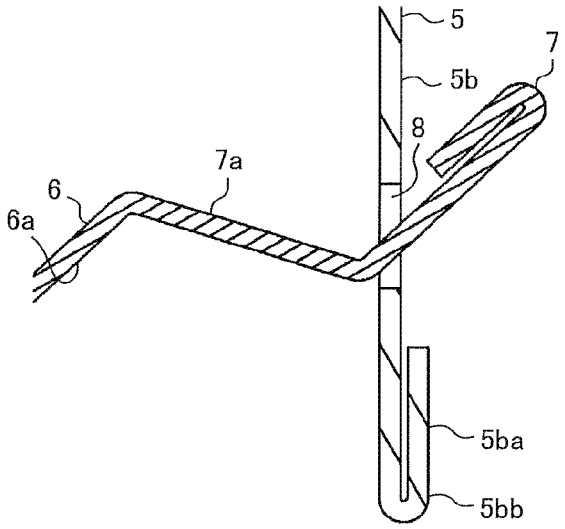
FIG. 7 is a diagram explaining an operation performed when the electric component cover of the electric component box in FIG. 2 is attached to the upper cover of the casing.

FIG. 7 is a diagram illustrating an operation performed when the electric component cover of the electric component box in FIG. 2 is attached to the upper cover of the casing.

When the electric component cover 6 is attached to the upper cover 5*b* of the casing 5, first, an operator inserts the catch 7 into the insertion slot 8 with the electric component cover 6 inclined. Then, as illustrated in FIG. 6, a back surface 6*a* of the electric component cover 6 is brought into contact with the front surface 5*ba* of the upper cover 5*b*. In this state, the operator passes a screw 10*a* through the screw hole 10 disposed in the lower end portion of the electric component cover 6 and screws the screw 10*a* into a screw hole 12 disposed in the casing body 5*a*. As a result, the electric component cover 6 is screwed to the casing body 5*a*. In the state where the electric component cover 6 is screwed to the casing body 5*a*, the backward-extending portion 7*a* of the catch 7 is positioned apart from a bottom surface 8*a* of the insertion slot 8.

Figure 8:
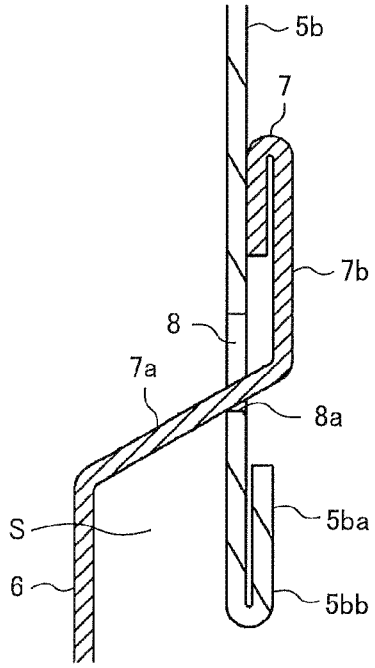
FIG. 8 is a sectional view of a relevant part in a state in which the electric component cover of the electric component box in FIG. 2 is prevented from falling.

When an operator accesses the control unit 4 in the casing 5 during maintenance, the operator removes the electric component cover 6 from the casing 5. That is, the operator first unscrews the screw 9*a* screwed to the casing body 5*a*. FIG. 8 given next illustrates a state of the electric component cover when the screw 9*a* is unscrewed.

FIG. 8 is a sectional view of a relevant part in a state in which the electric component cover of the electric component box in FIG. 2 is prevented from falling.

The electric component cover 6 falls, as a result of the screw 9*a* being unscrewed, from an initial position to a position at which the backward-extending portion 7*a* of the catch 7 is brought into contact with the bottom surface 8*a* of the insertion slot 8. However, as illustrated in FIG. 8, the electric component cover 6 is caught by the insertion slot 8 and thus is not separated and does not fall from the casing 5.

As described above, the length $L_1$ of the upward-extending portion 7*b* is set to be longer than the length $L_2$ of the insertion slot 8 of the upper cover 5*b* in the up-down direction. If $L_1$ is smaller than $L_2$, the upward-extending portion 7*b* of the catch 7 comes out of the insertion slot 8, and the electric component cover 6 falls. However, in the description, $L_1$ is longer than $L_2$, and thus the upward-extending portion 7*b* of the catch 7 is caught by a portion above the insertion slot 8 without coming out of the insertion slot 8. As a result, the electric component cover 6 can be prevented from falling from the casing 5. When $L_1$ is excessively long, it is difficult to attach the electric component cover 6 to the upper cover 5*b*, and thus the ease of assembly is impaired. Thus, it is preferable that the length of the upward-extending portion 7*b* be set in view of this point.

As described above, according to Embodiment 1 above, even if the electric component cover 6 is unscrewed from the casing 5, the catch 7 provided at the electric component cover 6 is caught by the portion above the insertion slot 8 provided in the casing 5. Thus, the electric component cover 6 can be prevented from falling from the casing 5. In this manner, the reason why the catch 7 is caught by the insertion slot 8 is because the length of the upward-extending portion 7*b* of the catch 7 in the up-down direction is longer than the length of the insertion slot 8 in the up-down direction.

In addition, the backward-extending portion 7*a* of the catch 7 has a shape that is extending obliquely backward and upward from the upper end portion of the electric component cover 6. Thus, when the catch 7 is caught by the portion above the insertion slot 8, the electric component cover 6 slides down forward along the slope of the backward-extending portion 7*a*. As a result, a space S (see FIG. 8) is created between the electric component cover 6 and the upper cover 5*b*. It becomes easy to visually check that the electric component cover 6 is unscrewed from the casing 5 by creating the space S in this manner.

The space S is configured to be sufficiently easy to visually check by setting "the length obtained by subtracting the thickness of the upper cover 5*b* from the length $L_3$ of the backward-extending portion 7*a* in the horizontal direction" to a certain value or more, and specifically, 5 mm or more. The maximum value of "the length obtained by subtracting the thickness of the upper cover 5*b* from the length $L_3$ of the backward-extending portion 7*a* in the horizontal direction" is set to 20 mm as described above. When this length is excessively long, it is difficult to recognize the insertion slot 8 when inserting the catch 7 into the insertion slot 8 during assembly. Thus, the maximum value is set to 20 mm in view of this point.

In addition, the curling portion 5*bb* is provided at the lower end portion of the upper cover 5*b*, and the curling portion 7*ba* is provided at the end portion of the upward-extending portion 7*b* of the catch 7. Thus, it is possible to prevent cut flaws from being made when the electric component cover 6 is attached to the electric component box 3. That is, it is possible to prevent the inconvenience of damaging the surface of the upper cover 5*b* from the upward-extending portion 7*b* of the electric component cover 6 or to prevent the inconvenience of damaging the surface of the electric component cover 6 from the lower end portion of the upper cover 5*b*.

Although the configuration in which the front of the casing 5 is open is illustrated herein, the position of the opening is not limited to the front. For example, in FIG. 2, the fall prevention structure of the present invention may be applied to an electric component cover that covers an opening at the right side of a casing. In short, the fall prevention structure of the present invention may be applied to an electric component box including a casing, a side of which is open, and an electric component cover that covers, in an upright position, the opening of the casing.

The entire configuration of the air-conditioning apparatus including the indoor unit 100 will be described herein.

Figure 9:
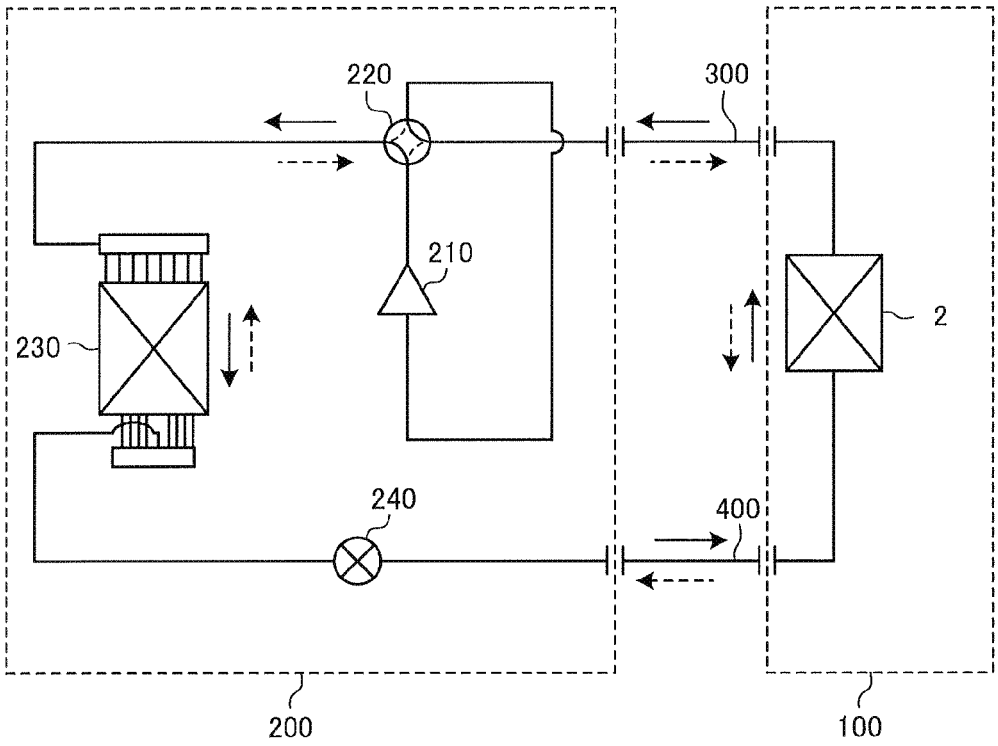
FIG. 9 is a diagram illustrating a refrigerant circuit of the air-conditioning apparatus according to Embodiment 1 of the present invention.

FIG. 9 is a diagram illustrating a refrigerant circuit of the air-conditioning apparatus according to Embodiment 1 of the present invention. In FIG. 9, broken-line arrows represent a refrigerant flow during a heating operation, and solid-line arrows represent a refrigerant flow during a cooling operation.

The air-conditioning apparatus is a so-called split air-conditioning apparatus and includes an outdoor unit 200 in addition to the indoor unit 100. The indoor unit 100 and the outdoor unit 200 are connected by a gas refrigerant pipe 300 and a liquid refrigerant pipe 400. The outdoor unit 200 includes a compressor 210, a four-way valve 220, an outdoor heat exchanger 230, and a pressure reducing device 240.

The compressor 210 compresses and discharges suctioned refrigerant. Although not particularly limited, the compressor 210 may be configured to freely change an operating frequency with an inverter circuit, for example, and to change the capacity of the compressor 210. The capacity means an amount of refrigerant sent by the compressor 210 per unit time. The four-way valve 220 is a valve that switches, for example, between a refrigerant flow during a cooling operation and a refrigerant flow during a heating operation.

The outdoor heat exchanger 230 exchanges heat between refrigerant and outdoor air. The outdoor heat exchanger 230 functions as an evaporator during a heating operation, and evaporates and gasifies refrigerant. In addition, the outdoor heat exchanger 230 functions as a condenser during a cooling operation and condenses and liquefies refrigerant.

The pressure reducing device 240 decompresses and expands refrigerant. The pressure reducing device 240 is composed of, for example, an electronic expansion valve and adjusts its opening degree in accordance with instructions, for example, from a controller (not illustrated). The indoor heat exchanger 2 exchanges heat, for example, between air-conditioning target air and refrigerant. The indoor heat exchanger 2 functions as a condenser during a heating operation and condenses and liquefies refrigerant. In addition, the indoor heat exchanger 2 functions as an evaporator during a cooling operation, and evaporates and gasifies refrigerant.

By configuring the air-conditioning apparatus as described above and switching refrigerant flows by the four-way valve 220, the air-conditioning apparatus can achieve a heating operation and a cooling operation.

Although Embodiment 1 above illustrates the indoor unit of the air-conditioning apparatus to which the fall prevention structure of an electric component cover of the present invention is applied, its application is not limited to an indoor unit of an air-conditioning apparatus. The fall prevention structure of an electric component cover of the present invention can also be applied to other refrigeration cycle apparatuses, such as a refrigerator or a freezer.

REFERENCE SIGNS LIST

1 casing 2 indoor heat exchanger 3 electric component box 4 control unit 5 casing 5*a* casing body 5*b* upper cover 5*ba* front surface 5*bb* curling portion 5*c* right cover 6 electric component cover 6*a* back surface 7 catch 7*a* backward-extending portion 7*b* upward-extending portion 7*ba* curling portion 8 insertion slot 8*a* bottom surface 9 screw hole 9*a* screw 10 screw hole 10*a* screw 11 screw hole 12 screw hole 100 indoor unit 200 outdoor unit 210 compressor 220 four-way valve 230 outdoor heat exchanger 240 pressure reducing device 300 gas refrigerant pipe 400 liquid refrigerant pipe S space

The invention claimed is:

1. A fall prevention structure of an electric component cover in a refrigeration cycle apparatus, the fall prevention structure comprising an electric component box housing an electric component of the refrigeration cycle apparatus, wherein the electric component box includes a casing, a side of which is open, and the electric component cover configured to cover, in an upright position, an opening of the casing and to be screwed to the casing, wherein the electric component cover includes a catch including a backward-extending portion and an upward-extending portion, the backward-extending portion extending backward from an upper end portion of the electric component cover, the upward-extending portion extending upward from an upper end portion of the backward-extending portion, wherein in a state in which the electric component cover is screwed to the casing, the catch is inserted into an insertion slot disposed in a portion extending in an up-down direction of the casing, and wherein when the electric component cover is unscrewed from the casing, the electric component cover does not fall from the casing by the catch being caught by a portion above the insertion slot.

2. The fall prevention structure of an electric component cover in the refrigeration cycle apparatus of claim 1, wherein a length of the upward-extending portion of the catch in the up-down direction is longer than a length of the insertion slot in the up-down direction.

3. The fall prevention structure of an electric component cover in the refrigeration cycle apparatus of claim 1, wherein the backward-extending portion of the electric component cover extends obliquely backward and upward from the upper end portion of the electric component cover.

4. The fall prevention structure of an electric component cover in the refrigeration cycle apparatus of claim 1, wherein a length obtained by subtracting a thickness of the portion in which the insertion slot is provided from a length of the backward-extending portion in a horizontal direction in a position in which the electric component cover is screwed to the casing is 5 mm or more and 20 mm or less.

5. The fall prevention structure of an electric component cover in the refrigeration cycle apparatus of claim 1, wherein the casing includes a casing body housing the electric component, and an upper cover covering an upper opening of the casing body, and wherein the insertion slot is formed in the upper cover.

6. The fall prevention structure of an electric component cover in the refrigeration cycle apparatus of claim 5, wherein the upper cover includes a first curling portion where a lower end portion of the upper cover is folded back, and wherein the upward-extending portion of the catch includes a second curling portion where an upper end portion of the upward-extending portion is folded back.

* * * * *